US005326252A

United States Patent [19]

Tonon

[11] Patent Number: 5,326,252

[45] Date of Patent: Jul. 5, 1994

[54] CATALYTIC COMBUSTION

[76] Inventor: Thomas Tonon, 35 Birch Ave., Princeton, N.J. 08542

[21] Appl. No.: 754,605

[22] Filed: Sep. 4, 1991

[51] Int. Cl.[5] ..... F28D 7/10

[52] U.S. Cl. ..... 431/2; 431/353; 126/91 A; 122/4 D; 165/154; 165/160

[58] Field of Search ..... 431/2, 5, 7, 350, 353; 126/391, 91 A, 91 R, 91 C, 350 R; 422/197, 312, 211; 122/4 A, 142, 161; 165/154, 160

[56] References Cited

U.S. PATENT DOCUMENTS

| | | | |
|---|---|---|---|
| 2,805,229 | 9/1957 | Metzger | 422/197 X |
| 2,986,454 | 5/1961 | Jewett | 422/197 |
| 3,499,797 | 3/1970 | Hooper | 422/197 X |
| 3,507,627 | 4/1970 | Frant et al. | 422/197 |
| 3,916,869 | 11/1975 | Dufour | 126/92 C X |
| 4,425,305 | 1/1984 | Retallick | 110/211 X |
| 4,459,126 | 7/1984 | Krill et al. | 431/7 |
| 4,730,599 | 3/1988 | Kendall et al. | 126/91 A |
| 4,739,826 | 4/1988 | Michelfelder et al. | 422/312 X |
| 4,870,824 | 10/1989 | Young et al. | 431/328 |
| 4,938,685 | 7/1990 | Noakes et al. | 431/7 X |

FOREIGN PATENT DOCUMENTS

| | | | |
|---|---|---|---|
| 289220 | 12/1986 | Japan | 431/7 |

*Primary Examiner*—Carl D. Price
*Attorney, Agent, or Firm*—George E. Kersey

[57] ABSTRACT

A self contained catalytic heating device within which a fuel/oxidizer mixture and combustion products are held out of physical contact with a heated medium, allowing the temperature of the catalytic material to be maintained at a level that is independent of the temperature at the surface in contact with the heated medium; materials and geometric dimensions can be chosen to achieve required temperatures for catalytically coated surfaces and heating surfaces, for example in a tubular construction.

19 Claims, 5 Drawing Sheets

CATALYTIC COMBUSTION

This invention relates to combustion, and more particularly, to combustion which takes place on a catalyst coated surface.

In catalytic combustion, the heating surface must be maintained at a temperature that is at, or above, the "light-off" temperature of the catalyst. The catalyst light off temperature is the minimum ignition temperature below which combustion cannot occur. The light off temperature depends upon the particular catalyst and the particular fuel/oxidizer mixture used in the system. An "oxidizer" is any fluid (including gases) that will support combustion, such as air or oxygen.

In some catalytic heating applications, it would be beneficial to be able to operate heating surfaces at temperatures below the "light-off" temperature of the catalyst. In other cases it would be desirable to improve the efficiency of the heating system.

Accordingly, it is an object of the invention to improve the versatility of catalytic combustion systems. A related object is to enhance the control that is exercisable over the operation of such systems. Another related object is to extend the operating ranges of such systems.

SUMMARY OF THE INVENTION

In accomplishing the foregoing and related objects invention provides a catalytic heater in which a first member has a plurality of wall surfaces, one of which is coated with a catalyst and another of which is uncoated. At least one second member is spaced from an uncoated wall surface of the first member. A gaseous fuel/oxidizer mixture is applied to the coated wall surface of the first member, and combustion is produced on the catalyst.

The second member is in contact with a medium to be heated, or with an additional member. Where there is an additional member, it is in contact with a medium to be heated, or with a further, additional member. Thus, any additional member is in contact either with a medium to be heated or another additional member. Moreover, more than one medium may be employed, in which case there is multimedia heating.

In accordance with one aspect of the invention, the first member has opposed wall surfaces, one of which is coated with a catalyst and another of which is uncoated. The second member faces and is spaced from the first member. The first member can be a catalytic inner tube having an inside wall coated with a catalyst; and the second member can be at least one outer tube surrounding the inner tube.

In accordance with another aspect of the invention, heat flow from the catalyst surface to the medium by way of the outermost tube is regulated, for example, by the use of prescribed materials, a prescribed geometry of tube construction, or by adjusting the fuel/oxidizer mixture ratio and flow rate.

In accordance with a further aspect of the invention, the inner tube can have a circular cross section, or a noncircular cross section, which can be rectangular. The inner tube also can be surrounded by a plurality of outer tubes, and the interval between the first and second members can be at least partially occupied by conductive packing material, or the interval between the first and second members can be maintained by a plurality of interconnecting fins.

In a method of catalytic heating in accordance with the invention, the steps include (a) providing a first member having a plurality of wall surfaces, one of which is coated with a catalyst and another of which is uncoated; (b) providing a second member spaced from an uncoated wall surface of the first member; (c) applying a gaseous fuel/oxidizer mixture to the coated wall surface of the first member and producing combustion on the catalyst; and (d) contacting the second member with a medium to be heated.

The method can include the steps of providing the first member with opposed wall surfaces, coating one of which with a catalyst and leaving another of which uncoated, and spacing the second member to face the first member.

The method can also include the steps of providing the first member as a catalytic inner tube having an inside wall coated with a catalyst; and the second member as at least one outer tube surrounding the inner tube. The method can further include the step of regulating heat flow from the catalyst surface to the medium through the outermost tube by using prescribed materials, a prescribed geometry of tube construction, adjusting the fuel/oxidizer mixture ratio and flow rate, or a combination of the foregoing. The light-off temperature of the catalyst on the first member can be maintained independently of the temperature of the second member.

In a method of constructing a catalytic heater, the steps include (a) fabricating a first member having a plurality of wall surfaces, one of which is coated with a catalyst and another of which is uncoated; (b) fabricating a second member spaced from an uncoated wall surface of the first member; and (c) providing for the application of a gaseous fuel oxidizing mixture to the coated wall surface of the first member and producing combustion on the catalyst. The first member can be a tube with either a circular or non-circular cross section. The second member can be a tube which surrounds the first member.

DESCRIPTION OF THE DRAWINGS

Other aspects of the invention will become apparent after considering several illustrative embodiments, taken in conjunction with the drawings, in which.

DETAILED DESCRIPTION

With reference to the drawings, FIG. A illustrates a catalytic combustion system in which five catalytic combustion tube heaters in accordance with the invention are supplied with a gaseous fuel/air mixture in conventional fashion. Air at an intake A-1 of an electric blower A-2 is applied to a duct A-3 to overcome the pressure drop that is inherent in the combustion tubes A-10 through A-14. Gaseous fuel is applied to an inner duct A-4, downstream of the blower A-2, and mixes with the air from the intake A-1. To initiate the heating operation from a relatively cold start, the resulting fuel-/air mixture is acted upon by an ignitor A-5. Following ignition, the catalytic tube heaters A-10 through A-14 facilitate combustion of the fuel and heat the medium A-6 in which the tubes A-10 through A-14 are immersed. The gaseous products of combustion then exit through an exhaust duct A-7.

Figure 1:
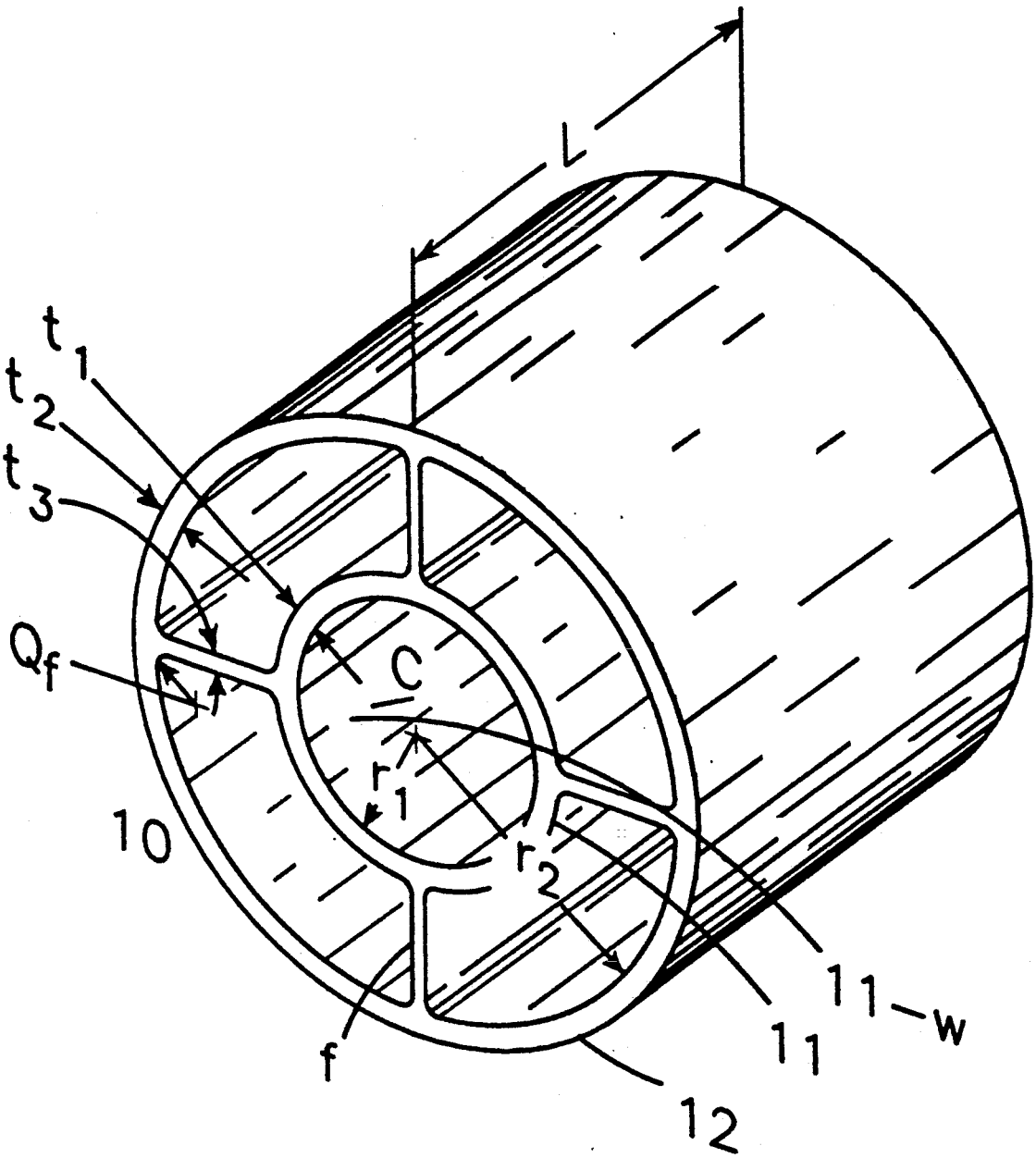
FIG. 1 is a perspective view of a catalytic tube heater in accordance with the invention.
Figure 1A:
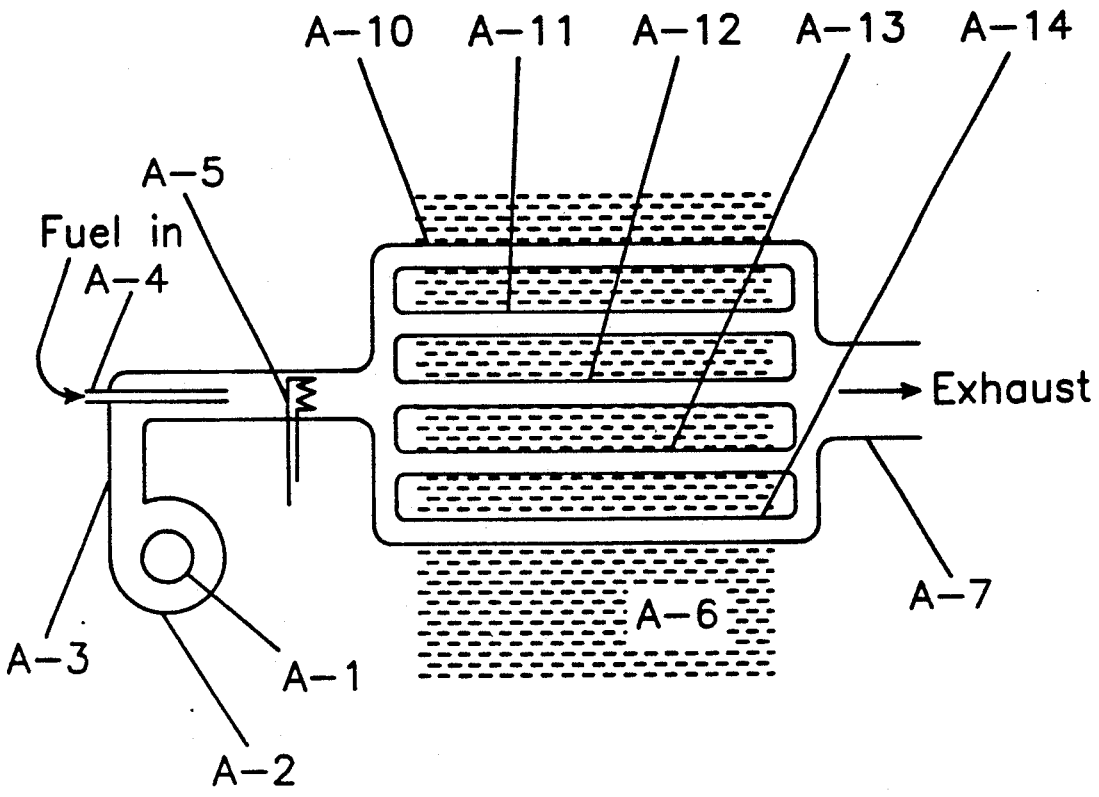
FIG. 1A is a schematic illustration of a catalytic combustion system in which a conventional fuel/air mixture is delivered to catalytic tube heaters, which are in accordance with the invention.

As shown in FIG. 1, the simplest form of catalytic tube heater 10 in accordance with the invention includes an inner tube 11 with an inside wall 11-*w* coated with a catalyst C. The tube 11 is placed inside an outer tube 12. A gaseous fuel/oxidizer mixture is applied to the coated inside wall 11-*w* and combustion takes place in conventional fashion. The axial length L of the heater 10 can be whatever is required. The outer tube 12 is in contact with the medium to be heated, and heat flows from the catalyst surface 11-*w* to the medium by way of the outermost tube 12. This flow is regulated by the materials and geometry of tube construction, as well as by fuel/oxidizer mixture ratio and flow rate. With the heat flow thus regulated, the temperature of the catalyst material can be maintained equal to or greater than the "light-off" temperature in a way that is independent of the outer tube temperature.

The way in which the central tube 11 is held within the outer tube 12 facilitates the invention and is determined by the use that is to be made of catalytic combustion pursuant to the invention. Typically, the outermost tube temperature will be fixed within certain bounds determined by the application that is to be made of the heater. Heat transfer from the central tube 11 to the outer tube 12 occurs by radiation, conduction, or by some combination of these, including convection. The heat transfer equals the amount of heat required to pass from the outer tube 12 to the medium being heated.

Consequently, the use being made of the heater determines not only the temperature range of the outermost tube 12, but also the quantity of heat released per unit surface area of the tube 12.

The fuel/oxidizer mixture that is applied to the catalytically coated inner wall 11-*w* is applied by a source (not shown) of conventional type associated with catalytic tube heating. The medium to be heated, including fluids and solids, is brought into contact with the outer wall of the outer tube 12 in conventional fashion.

The invention further allows convenient control over the temperature of the catalytically coated inner tube 11 in a way that is relatively independent of the temperature and heat release requirements of the outermost tube 12. With such control, the invention allows catalytic combustion at temperatures which can be necessarily higher than the temperature required at the outer wall of the tube 12.

The invention allows numerous applications of catalytic combustion that were previously unattainable.

The geometry and material constituency of the inner, catalytically-coated tube 11 is determined by the use being made of the catalytic heater.

Figure 2:
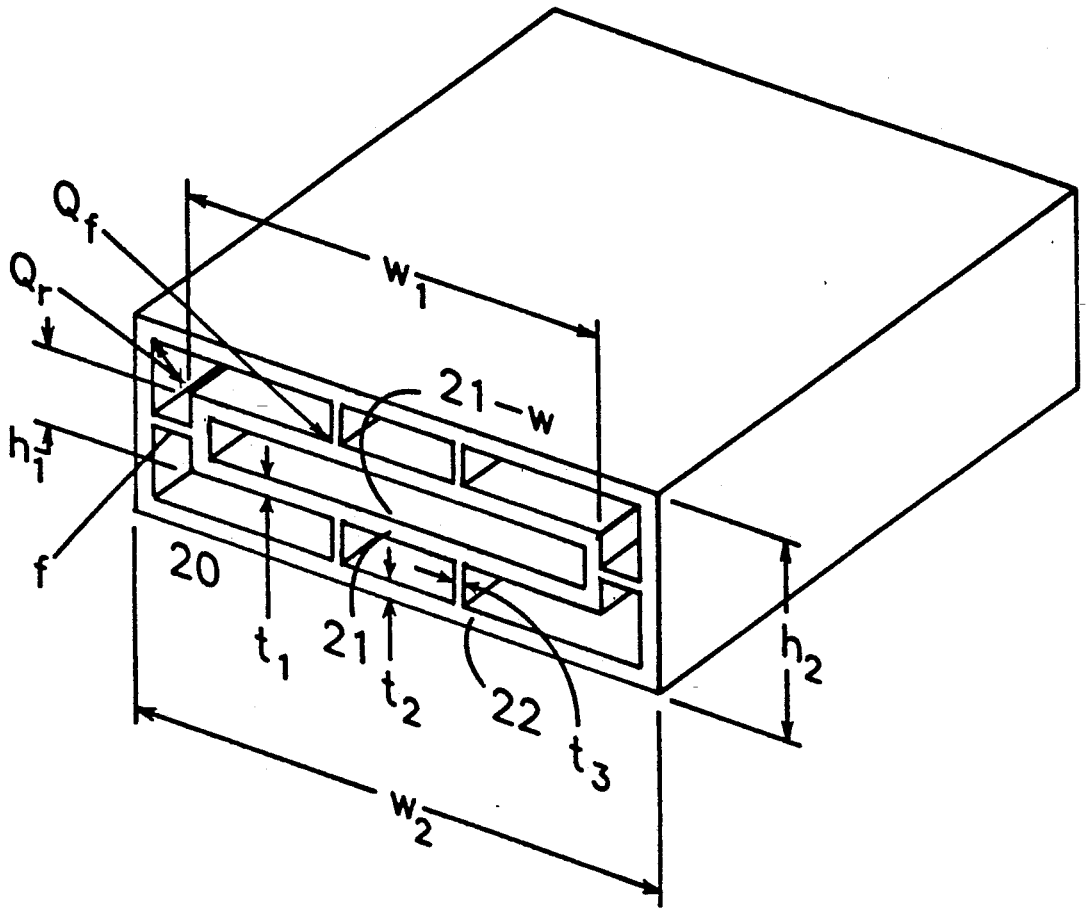
FIG. 2 is a perspective view of an alternative catalytic tube heater in accordance with the invention.
Figure 3:
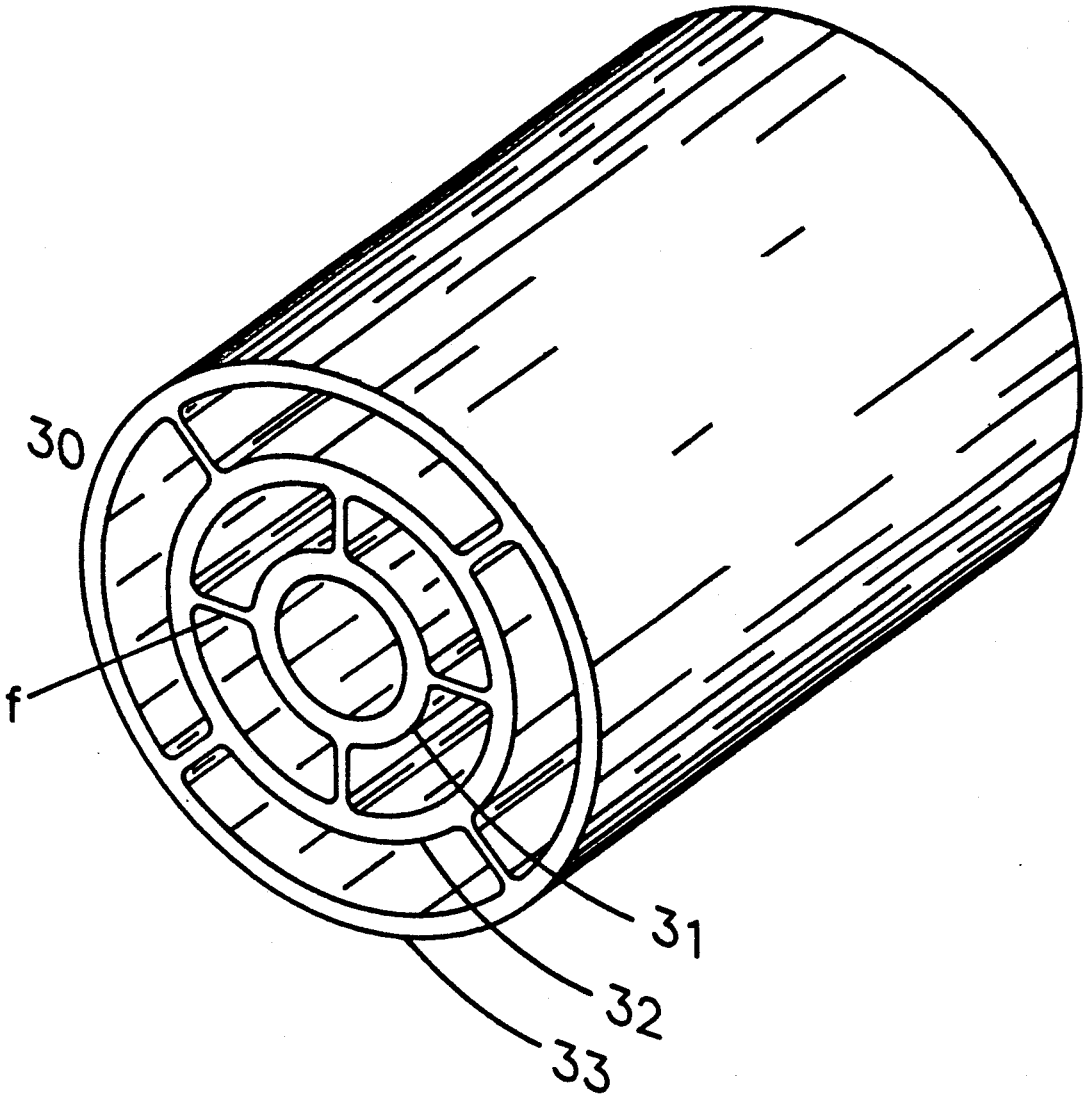
FIG. 3 is a perspective view of another alternative catalytic tube heater in accordance with the invention.
Figure 4:
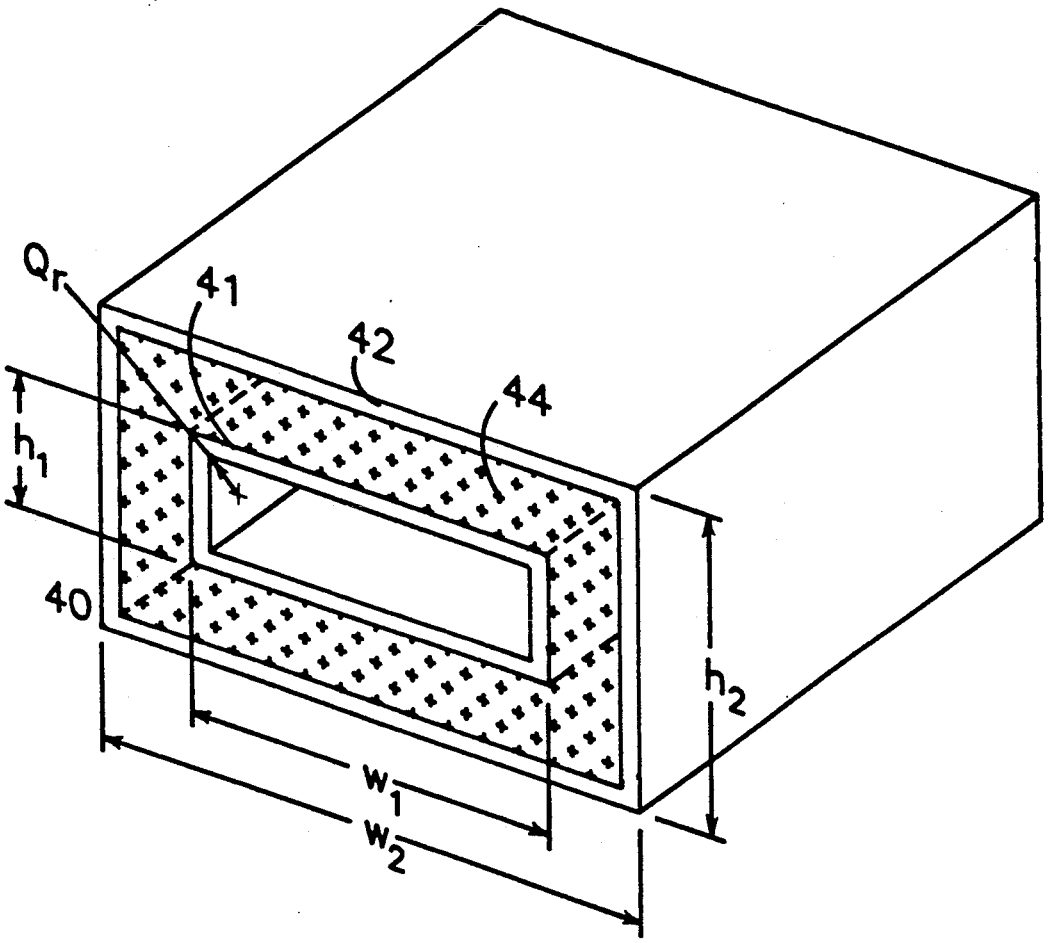
FIG. 4 is a perspective view of a further alternative catalytic tube heater in accordance with the invention.

In addition to the circular geometry of FIG. 1, other suitable geometries are shown in FIGS. 2–4. In FIG. 2 the heater 20 is formed by an inner, generally rectangular tube 21 with a catalytically coated inner wall 21-*w*. The inner tube 21 is surrounded by an outer, generally rectangular wall 22. Feed of the combustion mixture to the inner wall 21-*w* is in conventional fashion, as is contact of the medium to be heated with the outer tube 22.

In the further embodiment of FIG. 3, more than two tubes may comprise the burner 30. An inner, catalytically-coated tube 31 is surrounded by an intermediate tube 32 and an outermost tube 33. It will be appreciated that still other surrounding tubes may be employed and that the catalytic coating may be used not only with the innermost tube but with an intermediate tube as well, in which case appropriate arrangements are made for applying a suitable fuel/oxidizer mixture to the catalytic surface where combustion is to take place. In all cases, the initiation of combustion is in conventional fashion.

For the embodiments of FIGS. 1–3 the outer tube member (12 in FIG. 1 and 22 in FIG. 2) and members (32 and 33 in FIG. 3) are held in place by discrete fins f. In addition, for the modification of FIG. 2 by the heater 40 in FIG. 4, the catalytically coated inner tube 41 is spaced from a surrounding, medium-contacting tube 42 by a conductive packing material 44. It will be understood that the packing material may be used with the fins of FIGS. 1–3. As with the burner depicted in FIG. 1, the axial lengths of the burners depicted in FIGS. 2, 3 and 4 can be whatever is required.

With such geometries, the heat released per unit area of the outermost tube 12, 22, 33 and 42 can be conveniently controlled by choosing materials with specified thermal conductivities, and by choosing suitable dimensions for the various geometric elements associated with the heaters. These elements include the magnitudes of the radii $r_1$ and $r_2$; the thicknesses $t_1$, $t_2$ and $t_3$ of the walls and fins; the widths $w_1$ and $w_2$ of the inner and outer rectangular tubes; the heights $h_1$ and $h_2$ of the inner and outer rectangular tubes; the radii $Q_f$ associated with the fins f, and the radii $Q_r$ associated with the curved transitions between the long and short portions of the rectangular cross-sections. For simplicity, FIGS. 2 and 4 are illustrations of the special case where $Q_f = Q_r 0$.

When the fins f are used to support inner tubes 11, 21 and 31, radiation may play a significant role in determining the heat transfer from the inner tubes to the outermost tubes 12, 22 and 33. When packing material 44 is used between tubes 41 and 42, the thermal conductivity of this material, and the dimensions of the occupied volume can be chosen to satisfy the temperature and heat release requirements of the outermost tube.

The flow area and dimensions of the fuel/oxidizer passages are chosen to satisfy the overall heat output requirement per unit length of tubing. This requirement is easily satisfied because of the flexibility allowed by the availability of numerous geometric and other parameters. With such flexibility, axial variations in overall heat output per unit length of tubing can be accomodated. Thus, geometric and other parameters can be varied along the axial length of the tubing in order to provide constant heat output per unit length, or heat output in the axial direction otherwise prescribed.

A further requirement on the design elements is that thermal stresses not cause malfunctions in the burner. In some cases, it may be necessary not to fix an inner or outer tube member to the associated intermediate, thermal contacting spacing element (e.g. fins and/or packing material) so that relative motion is allowed or there is prevention of warpage due to thermal stresses.

The principles associated with determining the geometry, dimensions and materials for the burner 10 of FIG. 1, providing the simple case of two tubes 11 and 12, represented by the central, catalytically coated tube 11 and the single outer tube 12, are readily extended to determining the construction of a burner with any desired number of tubes.

Moreover, the invention can be extended to tubular constructions in which the catalyst coating is applied to the walls of imbedded tubes; i.e., outer or intermediate tubes with adjacent inner tubes on their inner and outer walls. The catalytic surface will include one or more annuli, and heat may be communicated to and from fluids flowing adjacent to the walls of the annuli.

The catalytic coating may be of any type commonly used in catalytic combustion. However, catalysts which are particularly appropriate include the following: platinum, palladium, rhodium, iridium, and any combination thereof.

It will be understood that the foregoing description is illustrative only and that other adaptations and constructions for the invention will be readily apparent to those of ordinary skill in the art.

What is claimed is:

1. A method of constructing a catalytic heater, comprising the steps of:

(a) fabricating a first fluid carrying member having a plurality of wall surfaces, one of which is coated with a catalyst and another of which is uncoated;

(b) fabricating a second member precluded from carrying the same fluid as said first member and having inner and outer wall surfaces, with said inner wall surface spaced from an uncoated wall surface of said first member and said outer wall surface receiving a medium to be heated; and (c) providing for the application of a gaseous fuel/oxidizer mixture to said coated wall surface of said first member and producing combustion on said catalyst.

2. The method of claim 1 wherein said first member is a tube having a geometric cross section and is surrounded by at least one outer tube.

3. A catalytic heater, comprising a first tubular member having at least two wall surfaces, one of which is coated with a catalyst and another of which is uncoated;

a second member spaced from an uncoated wall surface of said first member;

means for applying a gaseous fuel/oxidizer mixture to said coated wall surface of said first member and producing combustion on said catalyst;

means for contacting said second member with at least one medium to be heated;

wherein said first member is a catalytic inner tube with opposed wall surfaces, of which an inside wall surface is coated with a catalyst and another of which is uncoated, and said second member is a plurality of outer tubes facing, spaced from and surrounding said inner tube.

4. Apparatus as defined in claim 3 wherein said members are heat absorptive to provide substantially constant heat output per unit length.

5. A catalytic heater, comprising a first tubular member having at least two wall surfaces, one of which is coated with a catalyst and another of which is uncoated;

a second tubular member spaced from an uncoated wall surface of said first member;

means for applying a gaseous fuel/oxidizer mixture to said coated wall surface of said first member and producing combustion on said catalyst; and means for contacting said second member with at least one medium to be heated; wherein the interval between the first and second members is at least partially occupied by conductive packing material.

6. Apparatus as defined in claim 6 wherein said members are heat absorptive to provide substantially constant heat output per unit length.

7. A catalytic heater, comprising a first tubular member having at least two wall surfaces, one of which is coated with a catalyst and another of which is uncoated;

a second tubular member spaced from an uncoated wall surface of said first member;

means for applying a gaseous fuel/oxidizer mixture to said coated wall surface of said first member and producing combustion on said catalyst; and means for contacting said second member with at least one medium to be heated;

wherein the interval between the first and second members is maintained by a plurality of fins therebetween.

8. Apparatus as defined in claim 7 wherein said members are heat absorptive to provide substantially constant heat output per unit length.

9. A catalytic heater, comprising a first tubular member constituting a catalytic inner tube with opposed wall surfaces including an inside wall surface coated with a catalyst and an uncoated outside wall surface;

a second tubular member uniformly surrounding said inner tube and uniformly spaced from said uncoated wall surface of said first tubular member;

means for applying a gaseous fuel/oxidizer mixture to said coated wall surface of said first tubular member and producing combustion on said catalyst; and mean for contacting said second member with at least one medium to be heated.

10. Apparatus as defined in claim 9 further including means for regulating heat flow between the catalyst surface of said first tubular member and said second member.

11. Apparatus as defined in claim 10 wherein the regulating means comprises material inserted between the first and second members.

12. Apparatus as defined in claim 10 wherein the regulating means comprises material extending between said first and second members.

13. Apparatus as defined in claim 10 wherein the regulating means comprises inserted between the first and second members.

14. Apparatus as defined in claim 9 wherein said inner tube is selected from the class consisting of tubes with a circular cross section, a non-circular cross section and a rectangular cross section.

15. A method of catalytic heating, comprising the steps of:

(a) providing a first member having a plurality of wall surfaces, one of which is coated with a catalyst and another of which is uncoated;

(b) providing a second member having an outer surface and an inner surface surrounding and spaced from an uncoated wall surface of said first member;

(c) applying a gaseous fuel/oxidizer mixture to said coated wall surface of said first member and producing combustion on said catalyst; and (d) contacting said outer surface of said second member with at least one medium to be heated.

16. The method of claim 15 including the steps of providing said first member with opposed wall surfaces, coating one with a catalyst, leaving another uncoated, and uniformly spacing said second member from said first member.

17. The method of claim 15 including the steps of providing said first member as a catalytic inner tube having an inside wall coated with a catalyst; and said second member as at least one outer tube uniformly surrounding said inner tube.

18. The method of claim 15 including the step of regulating heat flow from the catalyst surface to the medium through the outermost tube, including providing substantially constant heat output per unit length.

19. The method of claim 15 wherein said catalyst has a light-off temperature including the step of maintaining the light-off temperature of said catalyst within said first member independently of the temperature of said second member.

* * * * *